US005732579A

United States Patent [19]

D'Hont et al.

[11] Patent Number: 5,732,579

[45] Date of Patent: Mar. 31, 1998

[54] KEY HAVING AN AIR COIL ANTENNA AND A METHOD OF CONSTRUCTION

[75] Inventors: Loek D'Hont, Almelo, Netherlands; Peter Mittertrainer, Munich, Germany

[73] Assignee: Texas Instruments Incorporated, Dallas, Tex.

[21] Appl. No.: 865,583

[22] Filed: May 29, 1997

Related U.S. Application Data

[63] Continuation of Ser. No. 627,800, Apr. 9, 1996, abandoned, which is a continuation of Ser. No. 348,267, Nov. 30, 1994, abandoned.

[51] Int. Cl.[6] ..... E05B 19/04

[52] U.S. Cl. ..... 70/278; 70/395; 70/408; 70/413; 235/375; 235/380; 340/825.54

[58] Field of Search ..... 70/276–283, 395, 70/408, 413; 235/375, 380; 340/825.54, 825.31, 825.69, 825.72; 307/10.2, 10.3, 10.7

[56] References Cited

U.S. PATENT DOCUMENTS

| | | | |
|---|---|---|---|
| 3,729,965 | 5/1973 | Gartner | 70/408 X |
| 4,663,952 | 5/1987 | Gelhard | 70/278 |
| 5,029,459 | 7/1991 | Almblad | 70/408 X |
| 5,117,097 | 5/1992 | Kimura et al. | 70/278 X |
| 5,311,757 | 5/1994 | Spahn | 70/278 X |
| 5,433,096 | 7/1995 | Janssen et al. | 70/395 X |

FOREIGN PATENT DOCUMENTS

| | | | |
|---|---|---|---|
| 2411290 | 8/1979 | France | 70/408 |
| 0164648 | 6/1990 | Japan | 70/408 |

*Primary Examiner*—Lloyd A. Gall

*Attorney, Agent, or Firm*—Rebecca Mapstone-Lake; James C. Kesterson; Richard L. Donaldson

[57] ABSTRACT

A key (10) is provided that includes a key body (12) having a forked end. The forked end comprises a first tine (14) and a second tine (16). A transponder (20) is disposed between the first tine (14) and the second tine (16). The transponder (20) is operable to generate signals. An air coil antenna (18) is coupled to the key body (12) proximate the forked end and is electrically coupled to the transponder (20). The air coil antenna (18) is operable to transmit signals generated by the transponder (20).

10 Claims, 1 Drawing Sheet

KEY HAVING AN AIR COIL ANTENNA AND A METHOD OF CONSTRUCTION

This application is a continuation of Ser. No. 08/627,800, filed on Apr. 9, 1996, now abandoned, which was a continuation of application Ser. No. 08/348,267, filed on Nov. 30, 1994, now abandoned entitled, Key Having an Air Coil Antenna and a Method of Construction by the following inventors: Loek D'Hont and Peter Mittertrainer.

TECHNICAL FIELD OF THE INVENTION

This invention relates in general to the field of electronic devices, and in particular to a key having an air coil antenna and a method of construction.

BACKGROUND OF THE INVENTION

Conventional key lock systems are used to protect property by providing secure access to houses, buildings, cars and other such property. Generally, a key lock system includes a key and key lock that has a lock mechanism.

For some applications, it is advantageous to have contactless key identification to provide security in addition to a mechanical match between a key and the key lock. These key lock systems are intelligent in that the key lock interrogates a key to determine whether the key matches the key lock. If the key does not match the key lock, the key lock will not allow mechanical activation of the locking mechanism. In some intelligent key lock systems, the key includes a transponder coupled to an antenna.

Conventional key antennas are ferrite-based comprising a solid ferrite core encircled by metal windings. Keys having these conventional antennas have limited lifetimes due to breakage of the ferrite core. If the ferrite core breaks, the antenna will no longer operate properly and the key is nonfunctional and will not be recognized by an associated key lock.

SUMMARY OF THE INVENTION

A need has arisen for an improved key for contactless key identification systems that provides contactless key identification during a longer lifetime of the key.

In accordance with the present invention, a key having an air coil antenna and a method of construction are provided that reduce or eliminate problems associated with prior keys in contactless key identification systems.

According to one embodiment of the present invention, a key is provided that includes a key body having a forked end. The forked end comprises a first tine and a second tine. A transponder is disposed between the first tine and the second tine. The transponder is operable to generate signals. An air coil antenna is coupled to the key body proximate the forked end and is electrically coupled to the transponder. The air coil antenna is operable to transmit signals generated by the transponder.

BRIEF DESCRIPTION OF THE DRAWINGS

A more complete understanding of the present invention and advantages thereof may be acquired by referring to the following description taken in conjunction with the accompanying drawings in which like reference numbers indicate like features, and wherein.

DETAILED DESCRIPTION OF THE INVENTION

Figure 1:
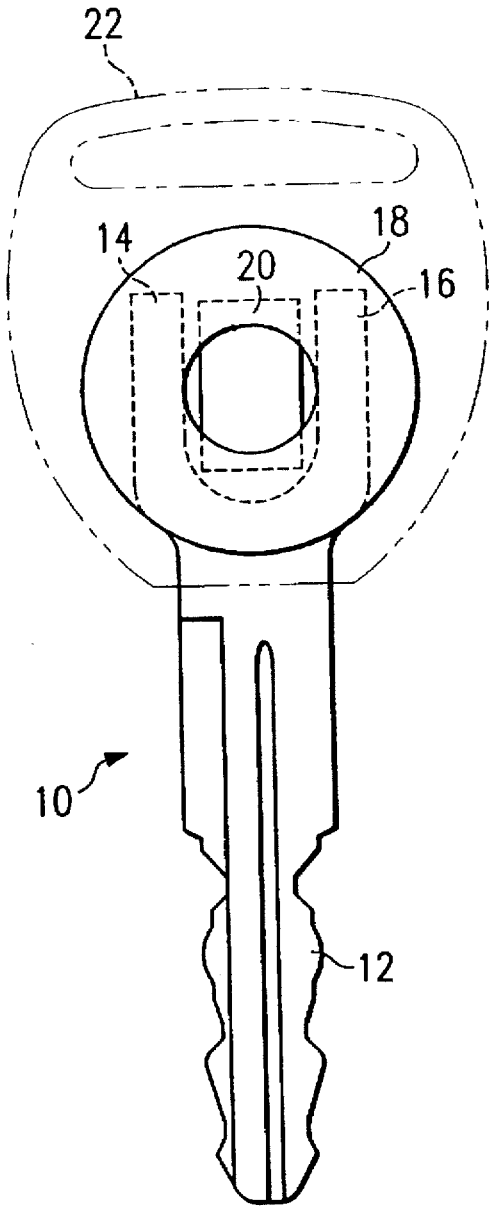
FIG. 1 is a front view with portions broken away of a key constructed according to the teachings of the present invention.

FIG. 1 is a front view with portions broken away of a key, indicated generally at 10, constructed according to the teachings of the present invention. Key 10 includes a metallic key body 12 having a forked end comprising a first tine 14 and a second tine 16, as shown. In alternate embodiments of the present invention, key body 12 can be constructed from nonmetallic, substantially rigid materials such as plastic.

An air coil antenna 18 is coupled to key body 12. A transponder 20 is disposed between tine 14 and tine 16 and is electrically coupled to air coil antenna 18. A nonmetallic grip 22 encases air coil antenna 18, transponder 20, and the forked end of metallic key body 12, as shown.

Key 10 operates to generate and transmit a signal to interrogation electronics associated with a key lock in a contactless key identification system. Transponder 20 comprises a transponder suitable to generate an appropriate signal for transmission. Transponder 20 can be selected according to application parameters such as read range, robustness against metal and other factors.

Metallic key body 12 can comprise a shape suitable for the desired application. In the illustrated embodiment, metallic key body 12 is a key shank having a first end and an opposed second forked end, as shown. This fork shape minimizes eddy currents in metallic key body 12 induced by the interrogation process. The fork shape also lowers metal detuning effects on transponder 20 and optimizes read range. The fork shape of metallic key body 12 does not affect the mechanical strength of metallic key body 12.

Air coil antenna 18 is electrically coupled to transponder 20 and operates to transmit signals from transponder 20. Air coil 18 has a longer lifetime compared to conventional ferrite-based antennas because there is no breakable ferrite core.

Figure 2:
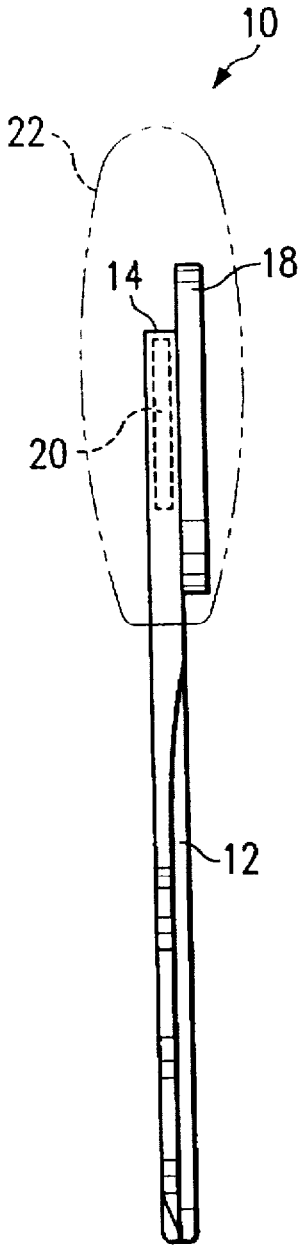
FIG. 2 is a side view of a key constructed according to the teachings of the present invention.

FIG. 2 is a side view with portions broken away of key 10. As shown, air coil antenna 18 is disposed adjacent to the surface of metallic key body 12. Transponder 20 is disposed adjacent to air coil antenna 18 and between tine 14 and tine 16. Air coil 18 comprises more turns than a comparably sized ferrite-based antenna to compensate for the absence of a ferrite core. The fork shape of metallic key body 12 breaks eddy currents induced in metallic key body 12, thus preventing interference with the function of transponder 20.

According to the teachings of the present invention, a key includes an air coil antenna coupled to a transponder disposed between tines of a forked end of a key body providing a robust key for contactless key identification systems. A key body having a forked end is a technical advantage of the present invention. This fork shape reduces eddy currents produced within a key body constructed from metallic material. A further technical advantage of the present invention is the use of an air coil antenna to provide a longer key lifetime.

Although the present invention has been described in detail, it should be understood that various changes, substitutions and alterations can be made hereto without departing from the spirit and scope of the invention as defined by the appended claims.

What is claimed is:

1. A key, comprising:

a key shank having a first end and an opposed second, forked end, the forked end comprising a first tine and a second tine, thereby reducing eddy currents;

a transponder disposed between the first tine and the second tine, the transponder operable to generate signals; and an air coil antenna, disposed outside said transponder and attached to the key shank adjacent each of the tines and electrically coupled to the transponder, the air coil antenna operable to transmit signals generated by the transponder.

2. The key of claim 1, further comprising a grip encasing the transponder, the air coil antenna, and the forked end of the key shank.

3. The key of claim 1, wherein the air coil antenna is disposed flush with the forked end of the key shank.

4. The key of claim 1, wherein the key shank is constructed from metal.

5. The key of claim 1, wherein the key shank is constructed from plastic.

6. A method of constructing a key for use in a contactless key identification system, comprising the steps of:

providing a key shank having a first end an opposed second, forked end, wherein the forked end comprises a first tine and a second tine;

disposing a transponder between the first tine and the second tine, the transponder operable to generate signals; and providing an air coil antenna, disposed outside said transponder, and attaching said air coil antenna to the key shank adjacent each of the tines and electrically connecting the air coil antenna to the transponder, such that the antenna is operable to transmit signals generated by the transponder.

7. The method of claim 6, further comprising the step of encasing the transponder, the antenna, and forked end of the key shank in a grip.

8. The method of claim 6, wherein the step of attaching comprises attaching the air coil antenna to the key shank such that the air coil antenna is disposed flush with the forked end of the key shank.

9. The method of claim 6, wherein the step of providing a key shank comprises providing a key shank constructed from metal.

10. The method of claim 6, wherein the step of providing a key shank comprises providing a key shank constructed from plastic.

* * * * *